US010874134B2

(12) United States Patent
Sutton

(10) Patent No.: US 10,874,134 B2
(45) Date of Patent: Dec. 29, 2020

(54) SMOKELESS ORAL TOBACCO PRODUCT AND PREPARATION THEREOF

(71) Applicant: British American Tobacco (Investments) Limited, London (GB)

(72) Inventor: Joseph Peter Sutton, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 127 days.

(21) Appl. No.: 14/648,392

(22) PCT Filed: Dec. 18, 2013

(86) PCT No.: PCT/GB2013/053336
§ 371 (c)(1),
(2) Date: May 29, 2015

(87) PCT Pub. No.: WO2014/096816
PCT Pub. Date: Jun. 26, 2014

(65) Prior Publication Data

US 2015/0296868 A1 Oct. 22, 2015

(30) Foreign Application Priority Data

Dec. 20, 2012 (GB) ..... 1222986.0

(51) Int. Cl.
*A24B 13/00* (2006.01)
*A24B 15/28* (2006.01)
(Continued)

(52) U.S. Cl.
CPC ..... *A24B 13/00* (2013.01); *A24B 15/14* (2013.01); *A24B 15/28* (2013.01); *A24B 15/30* (2013.01); *A24B 15/302* (2013.01); *A24B 15/42* (2013.01)

(58) Field of Classification Search
None
See application file for complete search history.

(56) References Cited

U.S. PATENT DOCUMENTS 3,894,544 A 7/1975 Egri
3,968,804 A * 7/1976 Kelly ..... A24B 3/14 131/370
(Continued)

FOREIGN PATENT DOCUMENTS

EP 0419975 A2 4/1991
GB 1570024 A 6/1980
(Continued)

OTHER PUBLICATIONS

International Search Report and Written Opinion, dated Mar. 14, 2014 for PCT/GB2013/053336, filed Dec. 18, 2013.
(Continued)

*Primary Examiner* — Joseph S Del Sole
*Assistant Examiner* — Manley L Cummins, IV
(74) *Attorney, Agent, or Firm* — McKee, Voorhees & Sease, PLC

(57) ABSTRACT

A smokeless oral tobacco product is provided comprising an insoluble foamed material. The insoluble foamed material is formed by combining a foaming agent, an agent capable of forming chemical cross-linkages and a cross-linking agent. A method of producing a smokeless oral tobacco product comprising an insoluble foamed material is also provided.

15 Claims, 6 Drawing Sheets

(51) Int. Cl.

| | |
|---|---|
| ***A24B 15/14*** | (2006.01) |
| ***A24B 15/42*** | (2006.01) |
| ***A24B 15/30*** | (2006.01) |

(56) References Cited

U.S. PATENT DOCUMENTS

| | | | | |
|---|---|---|---|---|
| 4,002,178 | A * | 1/1977 | Fiore | A24B 15/14 131/355 |
| 4,083,371 | A | 4/1978 | Beringer et al. | |
| 6,271,001 | B1 | 8/2001 | Clarke et al. | |
| 7,500,485 | B1 | 3/2009 | Shepard et al. | |
| 7,674,837 | B2 | 3/2010 | Gaserod et al. | |
| 2006/0191548 | A1 | 8/2006 | Strickland et al. | |
| 2007/0062550 | A1 * | 3/2007 | John | A24B 15/14 131/364 |
| 2008/0202533 | A1 | 8/2008 | Mishra et al. | |
| 2009/0038631 | A1 * | 2/2009 | Mishra | A24B 15/30 131/290 |
| 2009/0095313 | A1 * | 4/2009 | Fuisz | A24B 3/18 131/290 |
| 2009/0301505 | A1 * | 12/2009 | Liu | A24B 15/186 131/274 |
| 2011/0083685 | A1 | 4/2011 | Adams et al. | |
| 2011/0083688 | A1 | 4/2011 | Mishra et al. | |
| 2011/0104218 | A1 | 5/2011 | Karles et al. | |
| 2011/0232662 | A1 | 9/2011 | Liu et al. | |
| 2012/0031414 | A1 * | 2/2012 | Atchley | A24B 13/00 131/118 |
| 2012/0167901 | A1 * | 7/2012 | Onno | A24B 15/14 131/111 |

FOREIGN PATENT DOCUMENTS

| | | | |
|---|---|---|---|
| JP | 2007508835 | A | 4/2007 |
| JP | 2010525992 | A | 7/2010 |
| JP | 2013507105 | A | 3/2013 |
| JP | 2013507111 | A | 3/2013 |
| WO | 2005044026 | A1 | 5/2005 |
| WO | 2005046363 | A2 | 5/2005 |
| WO | 2006127772 | A2 | 11/2006 |
| WO | 2008059375 | A2 | 5/2008 |
| WO | 2009048522 | A1 | 4/2009 |
| WO | 2009048606 | A1 | 4/2009 |
| WO | 2009068279 | A1 | 6/2009 |
| WO | 2009087215 | A2 | 7/2009 |
| WO | 2009098591 | A2 | 8/2009 |
| WO | 2010080599 | A1 | 7/2010 |
| WO | 2011042172 | A1 | 4/2011 |
| WO | 2011042209 | A1 | 4/2011 |
| WO | 2011045010 | A2 | 4/2011 |

OTHER PUBLICATIONS

Written Opinion, dated Jan. 16, 2015 for PCT/GB2013/053336, filed Dec. 18, 2013.

International Preliminary Report on Patentability, dated Apr. 1, 2015 for PCT/GB2013/053336, filed Dec. 18, 2013.

Pocket Oxford Dictionary and Thesaurus, Oxford University Press, 2006, ISBN 0-19-530715-1, p. 310.

"2.9.1 Disintegration of Tables and Capsules." European Pharmacopoeia 7.0, 2.9 Pharmaceutical Technical Procedures, p. 253, dated Jan. 2009.

* cited by examiner

SMOKELESS ORAL TOBACCO PRODUCT AND PREPARATION THEREOF

CLAIM FOR PRIORITY

This application is the National Stage of International Application No. PCT/GB2013/053336, filed Dec. 18, 2013, which in turn claims priority to and benefit of United Kingdom Patent Application No. GB1222986.0, filed Dec. 20, 2012, The entire contents of the aforementioned applications are herein expressly incorporated by reference.

FIELD

The present invention relates to a smokeless oral tobacco product and methods of making the same.

BACKGROUND

Smokeless oral tobacco products comprise smokeless materials, such as smokeless tobacco, that are designed to be placed in the oral cavity of a user for a limited period of time. Smokeless oral tobacco products include snuff, which can be provided in dry or moist form. Smokeless oral tobacco products can be portioned or non-portioned.

In some embodiments, the present invention seeks to provide an improved smokeless oral tobacco product and a method for the production thereof.

SUMMARY

According to a first aspect of the present invention, a smokeless oral tobacco product is provided comprising tobacco and an insoluble foamed material. The insoluble foamed material is formed by combining a foaming agent, an agent capable of forming chemical cross-linkages and a cross-linking agent.

According to a second aspect of the present invention, a method is provided for the production of a smokeless oral tobacco product comprising tobacco and an insoluble foamed material. The insoluble foamed material is formed by:

(a) adding a foaming agent to an agent capable of forming chemical cross-linkages;

(b) foaming to produce a soluble foamed material; and (c) adding a cross-linking agent to produce an insoluble foamed material.

According to a third aspect of the present invention, an apparatus is provided to carry out the method according to the second aspect of the invention.

According to a fourth aspect of the present invention, a consumer package is provided, comprising the oral smokeless tobacco product according to the first aspect or produced by a method according to the second aspect of the invention.

BRIEF DESCRIPTION OF THE FIGURES

Embodiments of the invention are described, by way of example only, with reference to the accompanying drawings in which.

DETAILED DESCRIPTION

Figure 1:
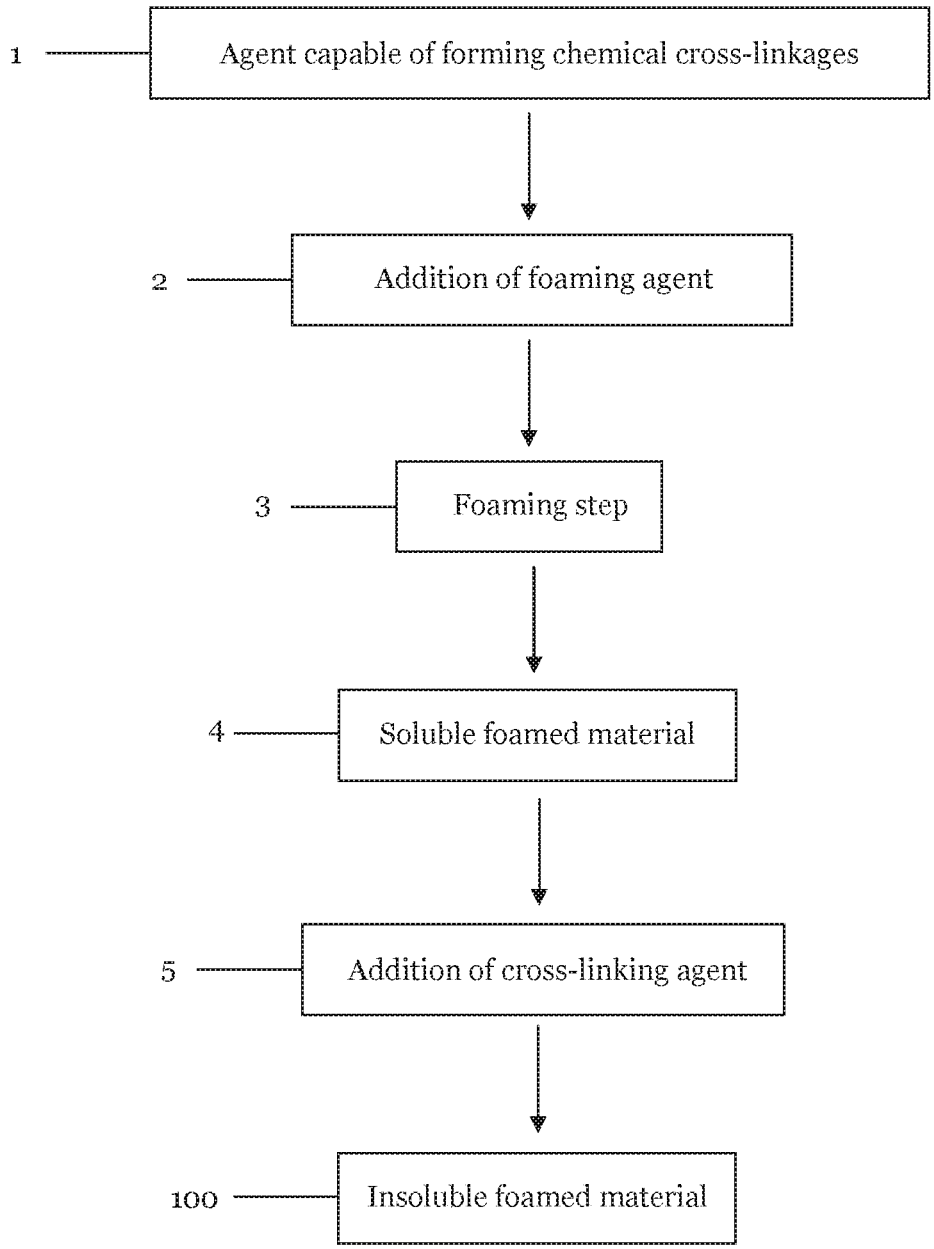
FIG. 1 is a flow diagram illustrating a method of producing an insoluble foamed material in accordance with an embodiment of the present invention.

The present invention relates to a smokeless oral tobacco product.

"Smokeless tobacco product" is used herein to denote any tobacco product which is not intended for combustion.

"Smokeless oral tobacco product" is used herein to denote any smokeless tobacco product designed to be placed in the oral cavity of a user for a limited period of time, during which there is contact between the user's saliva and the product. The term "smokeless oral tobacco product", as used herein, does not include heat-not-burn products.

A smokeless oral tobacco product can be provided to the user in a portioned or a non-portioned format. Portioned smokeless oral tobacco products can reduce or eliminate the handling of the tobacco by the user, which can offer significant advantages in terms of better hygiene, convenience and/or ease of use.

In some embodiments, the smokeless oral tobacco product of the present invention is a portioned product.

The smokeless oral tobacco product comprises tobacco. The tobacco may be present as a cross-linking agent or may be present in addition to a non-tobacco cross-linking agent.

"Tobacco" as used herein includes any part, such as the leaves, flowers, or stems, of any member of the genus *Nicotiana* and reconstituted materials thereof. In some embodiments, it includes treated tobacco. In some embodiments, it includes derivatives such as specific compounds found in natural tobacco, such as nicotine, whether extracted or synthesized, as well as structural derivatives such as the fibrous portion of a tobacco leaf. In some embodiments, it further includes tobacco substitutes which comprise individual chemicals and/or complex chemical entities which, when appropriately prepared, physically resemble natural tobacco. The term "tobacco" as used herein includes tobacco extract.

When the tobacco comprises plant material, defined amounts of the different parts of the plant may be used. For example, the amount of stem in the tobacco blend may be up to 15%, up to 30%, or up to 50% by weight of the tobacco. In some embodiments, the amount of stem in the tobacco is 0% by weight of the tobacco.

Tobaccos used in the present invention may include types of tobaccos such as dark air-cured tobacco, flue-cured tobacco, Burley tobacco, Oriental tobacco, Maryland tobacco, dark tobacco, dark-fired tobacco and Rustica tobaccos, as well as other rare or specialty tobaccos.

In some embodiments, the tobacco is ground tobacco and/or is in particulate form. In some embodiments, the tobacco is not in the form of strands or cut lamina.

In some embodiments, the tobacco may be snuff in dry or moist form. "Snuff" is used herein to generally describe a class of smokeless tobacco product which typically comprises cured tobacco which has been dried and ground to have a particle size of between 0.1 and 10 mm.

In some embodiments, some or all of the tobacco is in moist form. The moist tobacco may be in any form that is suitable for incorporation into a smokeless oral tobacco product. In some embodiments, the moist tobacco comprises moist snuff.

In some embodiments, the moist snuff comprises Swedish-style snuff, which may also be referred to as snus-style tobacco or snus. In embodiments in which the smokeless oral tobacco product comprises snus-style tobacco, the snus-style tobacco may comprise salt and/or other flavourants. Alternatively or in addition, the snus-style tobacco may be pasteurised or may undergo a process similar to pasteurisation and may optionally be matured, to reach the desired pH and/or moisture content of the snus-style tobacco. Methods and apparatus suitable for pasteurisation and maturation are known to the person skilled in the art.

Alternatively or in addition, the moist snuff may be in the form of dipping tobacco. In embodiments in which the smokeless oral tobacco product comprises dipping tobacco, the dipping tobacco may be treated by fermentation or may undergo a process similar to fermentation and may optionally undergo one or more further processes such as aging. Methods and apparatus suitable for the treatment of dipping tobacco are known to the person skilled in the art.

In addition to tobacco, the smokeless oral tobacco product comprises an insoluble foamed material. The smokeless oral tobacco product is substantially insoluble. This means that, following use, at least a portion of the product remains and has not dissolved or dispersed.

In some known portioned smokeless oral tobacco products, the tobacco is surrounded by a pouch. For example, a common method of providing moist snuff is to seal the tobacco material in a permeable pouch.

A pouch holds the tobacco material in place, while at the same time allowing substances such as flavours and nicotine to diffuse through the pouch and into the mouth of the user for absorption through the user's mucous membranes. However, using a pouch can prevent, limit or slow the diffusion of saliva into the tobacco material and/or the diffusion of substances from the tobacco material into the mouth of the user. The pouch can also be uncomfortable for the user, for example the seam where the pouch is sealed may be abrasive in the mouth of the user.

One of the challenges of providing a smokeless oral tobacco product comprising tobacco material without a pouch is ensuring that the tobacco material remains in place, together and intact in the user's mouth, whilst at the same time providing the pouchless smokeless oral tobacco product with characteristics such as density and mouth-feel that are acceptable to the user.

In some embodiments, the insoluble foamed material of the smokeless oral tobacco products of the invention may have a density that is selected and/or controlled so that it is suitable for a smokeless oral tobacco product and/or has a mouth-feel that is acceptable to the user.

Alternatively or in addition, in some embodiments the density of the insoluble foamed material may be selected to allow a desirable and/or predetermined rate of diffusion of saliva into the smokeless oral tobacco product and/or of substances from the smokeless oral tobacco product into the mouth of the user. Such diffusion rates may not be achieved without the low density insoluble foamed material of the present invention.

In some embodiments, the products further have a stabilised foamed structure. In other words, the insoluble foamed material may be resistant to collapsing, for example, during drying insoluble foamed material to the desired moisture content and/or during use, i.e. when placed in the mouth of the user. This allows the products to retain their structural integrity during use, whilst permitting release of components such as nicotine, flavours and the like.

In some embodiments, the insoluble foamed material of the smokeless oral tobacco product may further comprise other components. These components may, for example, be included in order to alter the organoleptic properties of the formulation, contributing to the sensory perception by the consumer.

In some embodiments, the insoluble foamed material may be formed into products of different shapes, sizes, surface textures, etc., which may be specifically designed for particular oral uses. For example, the mouldable nature of the material means that a product may be produced in a shape and/or with a surface texture which allows it to be comfortably held in a particular part of the oral cavity.

FIG. 1 illustrates a method to produce an insoluble foamed material according to an embodiment of the invention. A foaming agent is added 2 to an agent capable of forming chemical cross-linkages 1, and the resulting mixture undergoes a foaming step 3 to produce a soluble foamed material 4. Following the addition of a cross-linking agent 5, an insoluble foamed material 100 is formed.

In some embodiments, the agent capable of forming chemical cross-linkages may comprise an alginate. In some embodiments, the alginate has a high M ratio (i.e. with a high ratio of mannuronic acid residues to guluronic acid residues), as alginates with a high M ratio may form a less rigid gel structure than alginates with a high G ratio (i.e. with a high ratio of guluronic acid residues to mannuronic acid residues). In some embodiments, the agent capable of forming chemical cross-linkages comprises sodium alginate, ammonium alginate, potassium alginate and/or propylene glycol alginate. The person skilled in the art will be aware of other alginates that would be suitable as an agent capable of forming chemical cross-linkages. In some embodiments, the agent capable of forming chemical cross-linkages is sodium alginate.

Alternatively or in addition, the agent capable of forming chemical cross-linkages may comprise a pectin. Suitable pectins will be known to the person skilled in the art, and may comprise high methoxyl pectin.

Alternatively or in addition, the agent capable of forming chemical cross-linkages may comprise a carrageenan. Suitable carrageenans will be known to the person skilled in the art, and may comprise kappa carrageenan.

Other suitable agents capable of forming chemical cross-linkages will be known to the person skilled in the art.

The amount of agent capable of forming chemical cross-linkages used may be sufficient for a gel to form following the addition of a cross-linking agent. The amount of agent capable of forming chemical cross-linkages may comprise between about 1% and 10% and/or between about 1% and 5% wet weight of the total formulation (prior to any drying step). In some embodiments, the amount of agent capable of forming chemical cross-linkages is about 2% or less than 2% wet weight of the total formulation.

The agent capable of forming chemical cross-linkages may be hydrated. The agent capable of forming chemical cross-linkages may be hydrated by mixing with an aqueous solution, such as water. Any water may be used. In some embodiments, the agent capable of forming chemical cross-linkages is hydrated with purified water. As used herein, "purified water" relates to water treated to remove contaminants or impurities.

In some embodiments, the purified water is deionised water. Hydration may be particularly applicable for an aqueous agent capable of forming chemical cross-linkages.

In some embodiments, the foaming agent may be added to the agent capable of forming chemical cross-linkages. Alternatively, the agent capable of forming chemical cross-linkages may be added to the foaming agent.

In some embodiments, the foaming agent may have the ability to produce a foam structure. Substances suitable for use as a foaming agent may be amphiphilic and/or water-soluble. The foaming agent may comprise a foaming surfactant.

In some embodiments, the foaming agent may comprise a substituted cellulose capable of foaming. Suitable substituted celluloses include hydroxyl propyl methyl cellulose, hydroxy propyl cellulose, ethyl cellulose and methyl cellulose. In some embodiments, the foaming agent is hydroxy propyl methyl cellulose. Other suitable foaming agents will be known to the person skilled in the art. Alternatively or in addition, the foaming agent may comprise starch, sugar esters and/or proteins such as egg albumin.

In some embodiments, the amount of foaming agent used may be sufficient for foam to form during the subsequent foaming step. The amount of foaming agent may comprise between about 0.5% and 10% wet weight of the total formulation (prior to any drying step). In some embodiments, the amount of foaming agent is about 2% of the total formulation, optionally about 1.8% of the total formulation.

During and/or following the addition of the foaming agent to the agent capable of forming chemical cross-linkages, the mixture may be foamed.

Any suitable apparatus may be used for foaming the mixture. For the production of a smokeless oral tobacco product on a small scale, for example on a laboratory scale, a food mixer or balloon whisk may be used for foaming the mixture.

In some embodiments, the mixture may be foamed for a sufficient amount of time for foam to form and/or for the mixture to double in volume and/or for all of the mixture to be foamed. For example, in some embodiments, the mixture may be foamed for up to 1 minute, up to 2 minutes, up to 3 minutes, up to 4 minutes, up to 5 minutes, up to 10 minutes, up to 15 minutes, or up to 20 minutes. In some embodiments, the mixture is foamed for 1 to 3 minutes. In some embodiments, the mixture is foamed for at least 10 seconds, 20 seconds, 30 seconds, 40 seconds, 50 seconds or 1 minute.

In some embodiments, the foaming step may produce a foamed material that is water-soluble. In other words, the foaming step may produce a soluble foamed material.

In some embodiments, a cross-linking agent may be added to the agent capable of forming chemical cross-linkages. In some embodiments, the cross-linking agent is added following production of the soluble foamed material. Alternatively or in addition, the cross-linking agent may be added prior to and/or during production of the soluble foamed material.

In some embodiments, the cross-linking agent may be added to the foamed soluble material to form a gel that is insoluble in water. In other words, the addition of cross-linking agent may result in the production of an insoluble foamed material.

In some embodiments in which the agent capable of forming chemical cross-linkages comprises an alginate, pectin and/or carrageenan, the cross-linking agent may be a source of cations, typically polyvalent cations such as divalent and/or trivalent cations. Suitable polyvalent cations include $Ca^{2+}$, $Ba^{2+}$, $Sr^{2+}$, $Fe^{2+}$, $Zn^{2+}$, $Cu^{2+}$ and $Al^{3+}$. In some embodiments, the cross-linking agent is a source of divalent metal cations, and in some embodiments the cross-linking agent is a source of $Ca^{2+}$ ions.

In embodiments in which the cross-linking agent is a source of $Ca^{2+}$ ions, the cross-linking agent may comprise a calcium salt.

In some embodiments, the calcium salt is soluble or sparingly soluble at neutral pH (pH 7.0). Suitable calcium salts will be known to the person skilled in the art, and may comprise calcium sulphate and/or calcium citrate.

In some embodiments, the calcium salt may be insoluble at neutral pH and becomes soluble or sparingly soluble at acidic pH. Suitable calcium salts will be known to the person skilled in the art, and may comprise calcium carbonate and/or calcium phosphate. In some embodiments, the cross-linking agent comprises calcium carbonate.

Alternatively, the calcium salt may be insoluble at neutral pH and becomes soluble or sparingly soluble at alkaline pH. Suitable calcium salts will be known to the person skilled in the art, and may comprise calcium hydroxide.

Alternatively or in addition, in embodiments in which the cross-linking agent is a source of $Ca^{2+}$ ions, the cross-linking agent may comprise tobacco. Using tobacco as a cross-linking agent may confer the advantage that a lower level of non-tobacco ingredients, such as calcium carbonate for example, may need to be added to the smokeless oral tobacco product. Alternatively or in addition, desirable sensory qualities, such as tobacco flavour and aroma, and/or other desirable qualities, such as colour, may be added to the insoluble foamed material by using tobacco as a cross-linking agent.

When the cross-linking agent comprises tobacco, the tobacco may be in the form of moist snuff.

In embodiments in which the cross-linking agent comprises tobacco, the tobacco may be ground tobacco and/or particulate. The tobacco may have a particle size of between about 0.1 and 10 mm. In some embodiments in which the cross-linking agent comprises tobacco in the form of moist snuff, the tobacco may have a particle size of between about 0.1 and 1.0 mm.

The particle size of the tobacco may be selected according to the desired properties of the insoluble foamed material. For example, the size and distribution of the pores produced in the insoluble foamed material may be determined by selecting a particular particle size distribution, with a smaller tobacco particle size producing a larger number of small pores in the insoluble foamed material and a larger tobacco particle size producing a smaller number of large pores in the insoluble foamed material.

Alternatively or in addition, the particle size of the tobacco may influence the gelation rate of the soluble foamed material to the insoluble foamed material, and thus the particle size may be selected according to the desired rate of gelation.

In embodiments in which the tobacco comprises tobacco extract, a source of $Ca^{2+}$ ions may be added to the extract in order for the tobacco extract to perform effectively as a cross-linking agent.

When the cross-linking agent comprises a calcium salt, the amount used may comprise between about 0.01% and 5% wet weight of the total formulation (prior to any drying step). In some embodiments, the amount of calcium salt is between about 0.05 and 0.5% of the total formulation.

When the cross-linking agent comprises tobacco, the amount used may comprise between about 1% and 20% wet weight of the total formulation (prior to any drying step). The amount of tobacco may be up to 15% of the total formulation. In some embodiments, the amount of tobacco is between about 5 and 15% wet weight of the total formulation, and in some embodiments the amount of tobacco is about 9% of the total formulation.

It will be known to the person skilled in the art that different types of tobacco may provide different concentrations of free $Ca^{2+}$ ions in solution. Therefore, in embodiments in which the cross-linking agent comprises tobacco, the tobacco should be present in an amount capable of forming an insoluble foamed material.

The amount of cross-linking agent used may be sufficient for gelation to take place, whereby gelation comprises cross-linking of the agent capable of forming chemical cross-linkages. Thus, during gelation the soluble foamed material is converted to an insoluble foamed material.

It is desirable for the extent of gelation to be sufficient for the resulting insoluble foamed material to retain its structure following gelation, for example when the insoluble foamed material is placed in a mould immediately prior to gelation it may retain the shape of the mould following gelation. Advantageously, the extent of gelation of the insoluble foamed material is such that the smokeless oral tobacco product comprising the insoluble foamed material retains some or all of its structure when placed in the user's mouth. In other words, the extent of gelation is sufficient that the smokeless oral tobacco product comprising the insoluble foamed material does not disintegrate in the user's mouth.

The extent and/or rate of gelation may be determined by the level of cross-linking of the agent capable of forming chemical cross-linkages.

The level of cross-linking of the agent capable of forming chemical cross-linkages may be controlled by selecting the ratio of cross-linking agent to agent capable of forming chemical cross-linkages. In some embodiments in which the cross-linking agent is a source of $Ca^{2+}$ ions, the ratio of $Ca^{2+}$ ions to agent capable of forming chemical cross-linkages is 1:2. For example, in some embodiments in which the agent capable of forming chemical cross-linkages is an alginate, the ratio of $Ca^{2+}$ ions to alginate is 1:2.

In some embodiments, one or more pH modifier(s) may be added to modify the pH prior to, during or after the production of the soluble foamed material.

For example, in embodiments in which the cross-linking agent is added to the agent capable of forming chemical cross-linkages prior to foaming, one or more pH modifier(s) may be added following foaming to activate the cross-linking agent.

In embodiments in which the cross-linking agent is added prior to foaming and the cross-linking agent is active in acidic conditions, the pH modifier(s) may modify the pH of the mixture from substantially neutral to mildly acidic, for example, from a pH of about 7 to a pH of about 3 to 4.

In embodiments in which the cross-linking agent is active in acidic or mildly acidic conditions, the pH modifier may be glucono delta lactone. Alternative pH modifiers will be known to the person skilled in the art.

In some embodiments in which the pH modifier is glucono delta lactone, the pH may be modified from substantially neutral to a pH of 3 to 4 over 60 minutes at 25° C.

In embodiments in which the cross-linking agent is added prior to foaming and the cross-linking agent is active in alkaline conditions, the pH modifier(s) may modify the pH of the mixture from substantially neutral to mildly alkaline.

In embodiments in which the cross-linking agent is active in alkaline or mildly alkaline conditions, the pH modifier may comprise calcium hydroxide, sodium hydroxide and/or magnesium hydroxide. Alternative pH modifiers will be known to the person skilled in the art.

In some embodiments, the one or more pH modifier(s) does not cause degradation of the other components present in the mixture, such as the agent capable of forming chemical cross-linkages, foaming agent and/or humectants(s).

The amount of pH modifier used may be sufficient for the pH of the mixture to change. The pH modifier may comprise between about 0.5% and 5% wet weight of the total formulation (prior to any drying step). In some embodiments, the amount of pH modifier used is about 1% of the total formulation.

In some embodiments, adding cross-linking agent to the foamed mixture may commence gelation. Alternatively or in addition, in embodiments in which the soluble foamed material comprises cross-linking agent, adding further cross-linking agent and/or one or more pH modifier(s) to the soluble foamed material may commence gelation.

When the cross-linking agent is provided in the form of particles, the particle size of the cross-linking agent may affect gelation. For example, when the cross-linking agent comprises calcium carbonate particles, the time taken for gelation to commence may be longer when larger particles are used compared with the time taken for gelation to commence with cross-linking agent comprising smaller calcium carbonate particles. Without being bound by theory, it is thought that the cross-linking agent is released more slowly from the larger particles as a result of the lower surface area to volume ratio than smaller particles. Accordingly, when the cross-linking agent comprises calcium carbonate particles and the foamed soluble material is acidic, the larger calcium carbonate particles dissolve slower and thus release calcium ions more slowly than smaller calcium carbonate particles.

In some embodiments, the particles of cross-linking agent may have a diameter of between about 1 μm and 250 μm. The particles of cross-linking agent may have a diameter of up to about 10 μm, up to about 20 μm, up to about 30 μm, up to about 40 μm, up to about 50 μm, up to about 60 μm, up to about 70 μm, up to about 80 μm, up to about 90 μm, up to about loom, up to about 150 μm, up to about 200 μm, or up to about 250 μm. Optionally, the particles have a diameter of at least 1 μm, 5 μm, 10 μm, 20 μm or at least 50 μm. In some embodiments, the diameters of the particles of cross-linking agent are between about 50 μm and 100 μm. In some embodiments, the diameters of the particles of cross-linking agent are about 75 μm.

Figure 2:
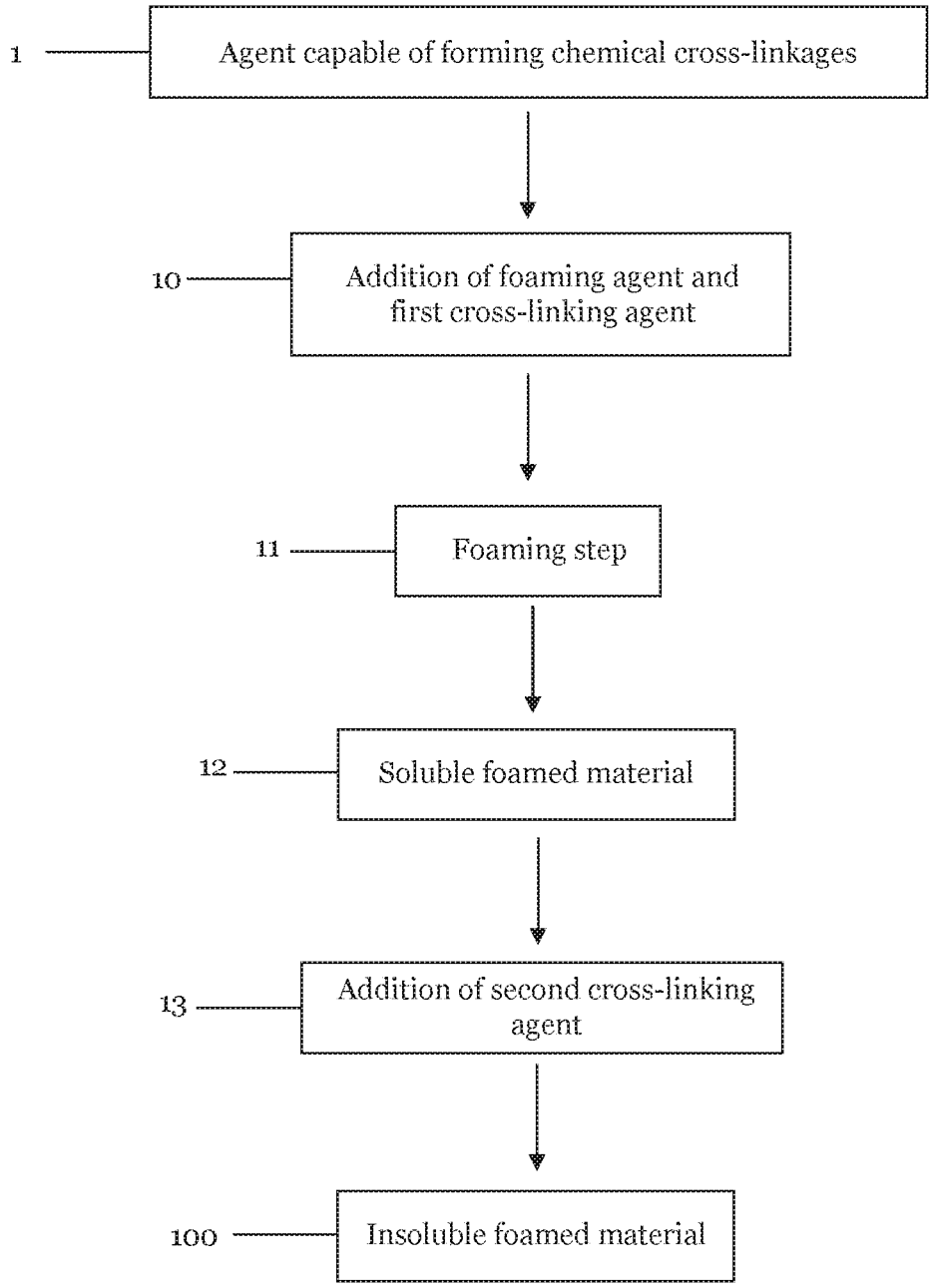
FIG. 2 is a flow diagram illustrating a method of producing an insoluble foamed material in accordance with an embodiment of the present invention.

FIG. 2 illustrates an embodiment in which cross-linking agent is added prior to and following the production of a soluble foamed material. Foaming agent and a first cross-linking agent are added 10 to the agent capable of forming chemical cross-linkages 1 and the mixture undergoes a foaming step 11 to produce a soluble foamed material 12. A second cross-linking agent is added 13 to the soluble foamed material, to produce an insoluble foamed material 100.

The first cross-linking agent added may be different from the second cross-linking agent. Alternatively, the second cross-linking agent may be the same as the first cross-linking agent.

In some embodiments, the first cross-linking agent is calcium carbonate and the second cross-linking agent is tobacco.

In embodiments in which the first cross-linking agent is inactive at the pH of the soluble foamed material, a pH modifier may be added to the soluble foamed material, for example with the second cross-linking agent. In some embodiments in which the first cross-linking agent is calcium carbonate, the pH modifier added with the second cross-linking agent is glucono delta lactone.

Figure 3:
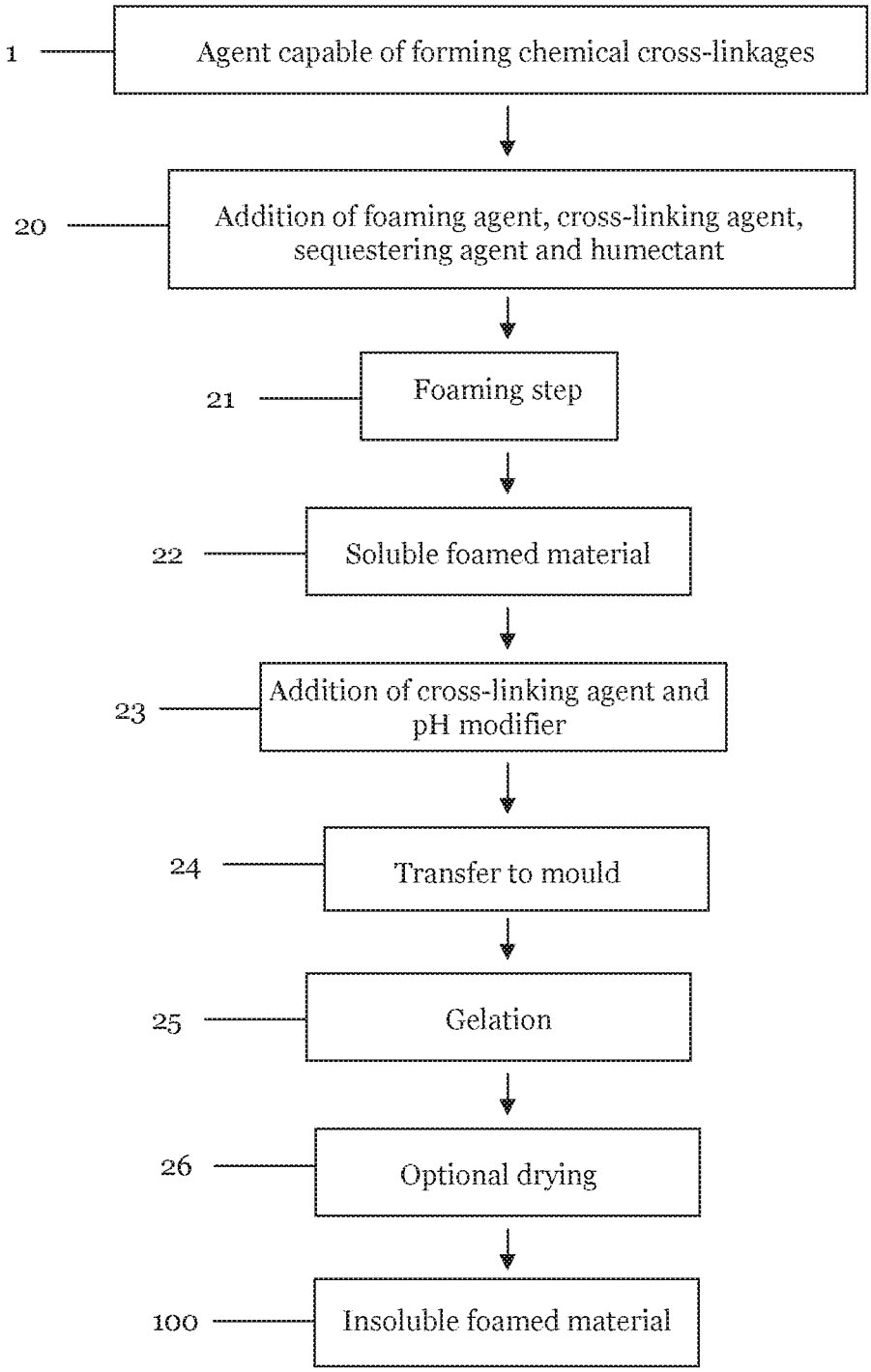
FIG. 3 is a flow diagram illustrating a method of producing an insoluble foamed material in accordance with an embodiment of the present invention.

FIG. 3 illustrates a method of producing an insoluble foamed material according to an embodiment of the invention. In this embodiment, a foaming agent, a first cross-linking agent and a humectant are added 20 to an agent capable of forming chemical cross-linkages 1. The resulting mixture undergoes a foaming step 21, to produce a soluble foam material 22. A second cross-linking agent and a pH modifier are added 23, and the resulting mixture is transferred to a mould 24 prior to the onset of gelation 25. Optionally, if the moisture content is not at a desirable level, the gel is dried 26, resulting in an insoluble foamed material 100.

One or more sequestering agent(s) may be added prior to, during and/or after the production of a soluble foamed material.

One or more sequestering agent(s) may be added to control the rate of cross-linking and/or to delay the onset of gelation, for example to allow sufficient time to transfer to a mould. The addition of one or more sequestering agent(s) may be particularly advantageous when the cross-linking agent is soluble or highly soluble in aqueous solution. Such sequestering agents act by sequestering the cross-linking agent that is in solution. For example, in embodiments in which the cross-linking agent is a source of $Ca^{2+}$ ions, a sequestering agent that is capable of sequestering $Ca^{2+}$ ions in solution may be added.

Suitable sequestering agents to sequester $Ca^{2+}$ ions in solution include sodium polyphosphate and/or EDTA. Alternative sequestering agents suitable for $Ca^{2+}$ ions in solution will be known to the person skilled in the art.

One or more humectant(s) may be added prior to, during and/or after the production of a soluble foamed material. In some embodiments, one or more humectant(s) is added prior to the production of a soluble foamed material.

The one or more humectant(s) may be added to achieve the desired physical properties, such as the desired flexibility and/or malleability, of the insoluble foamed material. Humectants suitable for this will be known to the person skilled in the art. Exemplary humectants include glycerol and/or propylene glycol.

The amount of humectant(s) used may be sufficient to achieve the desired physical properties of the insoluble foamed material. The amount of humectant(s) may comprise between about 1% and 30% wet weight of the total formulation (prior to any drying step). In some embodiments, the amount of humectant is between about 9% and 10% of the total formulation, optionally about 9.1% or about 10% of the total formulation. In some embodiments, the amount of humectant is greater than 5% of the total formulation.

The soluble foamed material may be placed into a mould or cast. The soluble foamed material may be placed into a mould or cast prior to and/or during the onset of gelation. In some embodiments, the soluble foamed material is placed into a cast or mould prior to the onset of gelation.

The onset of gelation may be determined by the addition of the cross-linking agent and/or pH modifier(s) to the soluble foamed material. The onset of gelation may be sufficiently rapid to retain the bubbles or foamed structure and at the same time the onset of gelation may have a sufficient delay to place the soluble foamed material in a mould or cast prior to gelation. In some embodiments, the onset of gelation occurs between about 10 seconds and 15 minutes after the addition of the cross-linking agent and/or pH modifier(s) to the soluble foamed material. In some embodiments, the onset of gelation occurs between about 30 seconds and 5 minutes after the addition of the cross-linking agent and/or pH modifier(s) to the soluble foamed material.

The soluble foamed material may be placed into a mould or cast of a defined shape, so that the insoluble foamed material has that shape following gelation.

The soluble foamed material may be placed into a mould or cast of a defined volume. The mould or cast may have a volume and shape that correspond to the desired size and shape of the smokeless oral tobacco product. The mould or cast may have a volume that is larger than the desired volume of the smokeless oral tobacco product, and the resulting insoluble foamed material may be reduced in size, by stamping or cutting, for example.

The insoluble foamed material may have any shape following gelation. In some embodiments, the shape of the insoluble foamed material may be a sphere, tablet, disk or lozenge.

In some embodiments, the insoluble foamed material is produced using an extruder.

Figure 4:
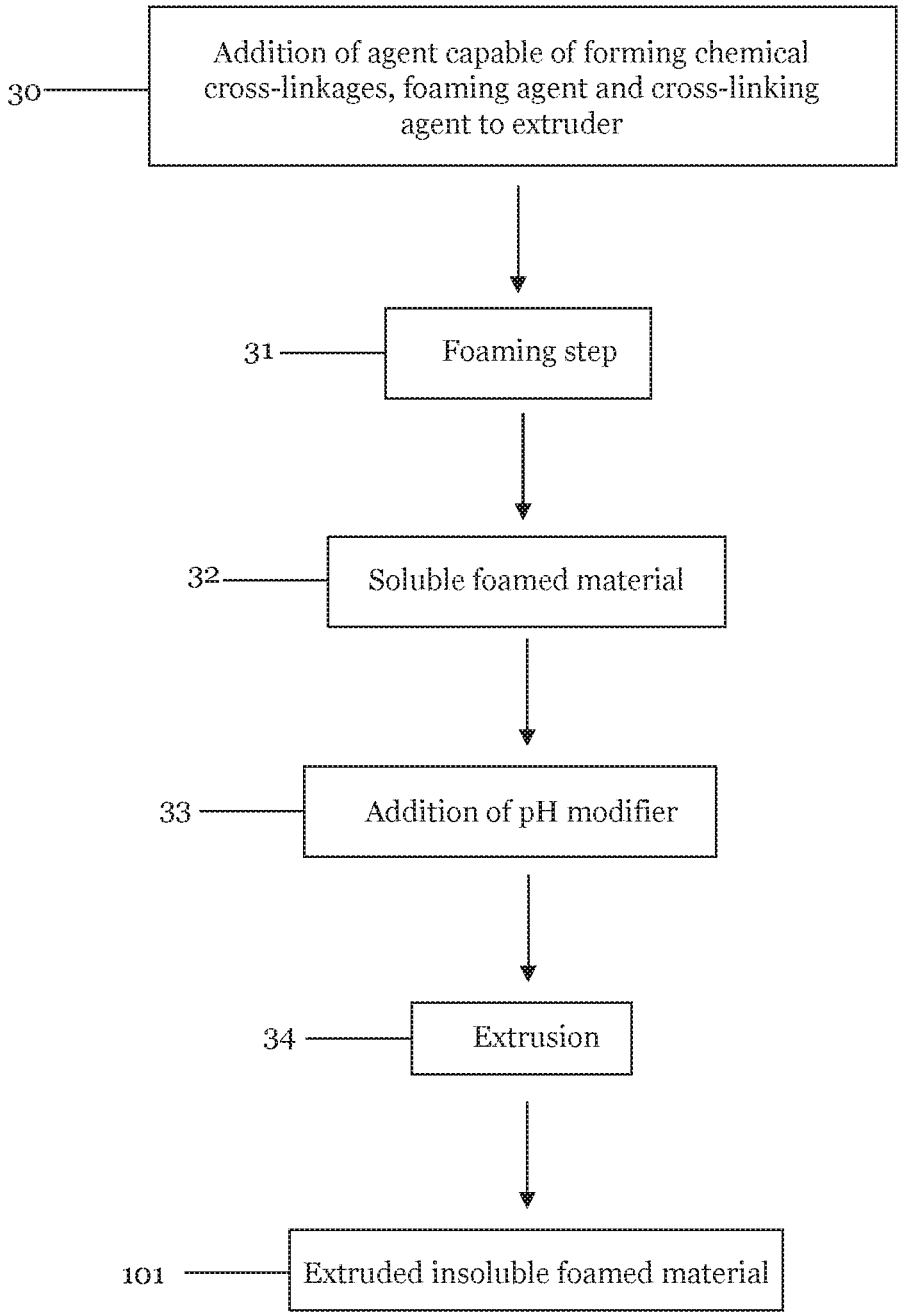
FIG. 4 is a flow diagram illustrating a method of producing an insoluble foamed material in accordance with an embodiment of the present invention.

FIG. 4 illustrates a method of producing an insoluble foamed material according to an embodiment of the invention. An agent capable of forming chemical cross-linkages, a foaming agent, and a cross-linking agent are added to an extruder apparatus 30 and the resulting mixture undergoes a foaming step 31 to produce a soluble foamed material 32. Following the addition of a pH modifier 33, the soluble foamed material is extruded 34 prior to the onset of gelation, resulting in an extruded insoluble foamed material 101.

The foaming step during extrusion may comprise the injection of gas into the mixture and/or vigorous mixing of the agent capable of forming chemical cross-linkages, foaming agent and cross-linking agent.

The mixing of the components to produce the insoluble foamed material may comprise high shear mixing. Alternatively or in addition, the mixing of the components to produce the insoluble foamed material may comprise low shear mixing. In some embodiments, the mixing of the agent capable of forming chemical cross-linkages, foaming agent and cross-linking agent is high shear mixing and the mixing of the pH modifier is low shear mixing.

In some embodiments, the insoluble foamed material is extruded into a mould or die.

Extrusion may take place under any suitable temperature and pressure. In some embodiments, there is a low pressure differential at the extruder exit, in order for the integrity of the soluble foamed material to be maintained.

Any suitable extruder to create the extruded insoluble foamed material may be used.

Figure 5:
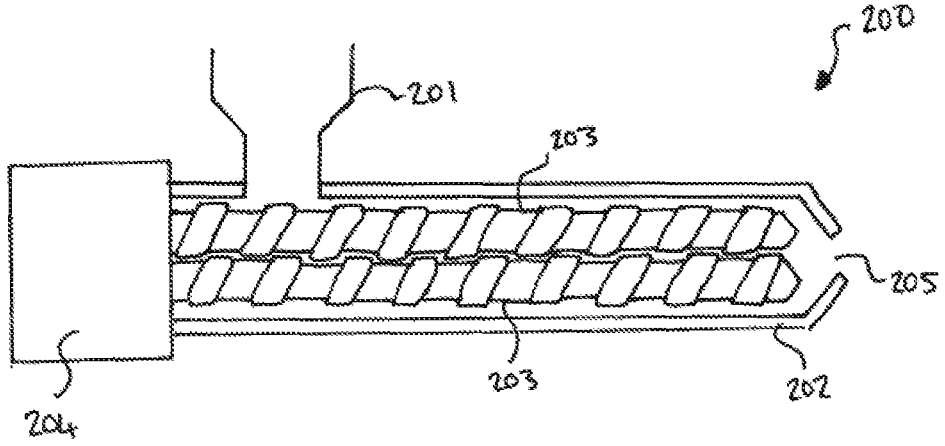
FIG. 5 is a diagram illustrating an apparatus for producing an insoluble foamed material in accordance with an embodiment of the present invention.

FIG. 5 is a diagram illustrating an extruder for producing an insoluble foamed material in accordance with an embodiment of the present invention. In this embodiment, a twin screw extruder 200 is used to produce an insoluble foamed material. The agent capable of forming chemical cross-linkages, foaming agent, and cross-linking agent are added to a hopper 201, and following foam production and the addition and mixing of a pH modifier, the resulting soluble foamed material is released into the barrel 202 containing the twin screws 203, which are driven by the motor, gear reducer and thrust bearing 204. The soluble foamed material is extruded through an opening 205 prior to the onset of gelation.

Alternatively or in addition, the extruder may be a single screw extruder (not shown).

The method of the present invention may be carried out at any suitable temperature. In some embodiments, a part of or all of the method is carried out at up to about 50° C., to eliminate or reduce any undesirable effects of the temperature on the characteristics of the insoluble foamed material. For example, a part of or all of the method may be carried out at up to about 50° C. to avoid the insoluble foamed material adopting a yellow colour. In some embodiments, a part of or all of the method is carried out at ambient temperature.

The level of moisture of the insoluble foamed material may affect the release of nicotine. For example, nicotine may be released faster in the user's mouth from a smokeless oral tobacco product comprising insoluble foamed material with a higher moisture content than from a smokeless oral tobacco product comprising insoluble foamed material with a lower moisture content.

Alternatively or in addition, the level of moisture of the insoluble foamed material may affect its flexibility and/or malleability. For example, insoluble foamed material with a particular moisture content may have a flexibility and/or malleability that is desirable for shaping the insoluble foamed material for placing into the user's oral cavity.

The moisture content of the insoluble foamed material may be between about 5% and 95%. In some embodiments, the moisture content of the insoluble foamed material may be between about 30% and 55%. The moisture content of the insoluble foamed material may be up to 60%, up to 70%, up to 80%, up to 90% or up to 95%. The moisture content of the insoluble foamed material may be between about 80% to about 90%, for example, for use in a substantially non-dried smokeless oral tobacco product. In some embodiments the moisture content is above 25%, above 27%, above 30% or above 35%. In some embodiments the moisture content is at least 25%, at least 27%, at least 30% or at least 35%. Alternatively, the moisture content of the insoluble foamed material may be about 5%, for example, for use in a substantially dried smokeless oral tobacco product. In some embodiments, the moisture content of the insoluble foamed material is between 30 and 50%.

If the insoluble foamed material does not have the desired moisture content, the insoluble foamed material may be dried to the desired moisture content.

In some embodiments, the insoluble foamed material may be dried by placing at an elevated temperature. The temperature may be selected in accordance with the desired moisture content and/or drying time. For example, the insoluble foamed material may be dried by placing at a temperature of up to 30° C., up to 40° C., or up to 50° C. In some embodiments, the insoluble foamed material is dried by placing in an oven.

The drying time may be selected in accordance with the desired moisture content, the desired drying temperature and/or the size and/or shape of the insoluble foamed material. The drying time may be up to 1 hour, up to 2 hours, up to 3 hours, up to 4 hours, up to 5 hours, up to 6 hours, up to 7 hours, up to 8 hours, up to 9 hours, up to 10 hours, up to 11 hours, up to 12 hours, up to 15 hours, or up to 20 hours. In some embodiments, the insoluble foamed material is dried overnight.

In some embodiments, the insoluble foamed material is dried overnight at about 40° C.

The insoluble foamed material may have properties that are desirable for a smokeless oral tobacco product. For example, the insoluble foamed material may have a density that is suitable for a smokeless oral tobacco product and/or has a mouth-feel that is acceptable to the user.

Conventional snus has a density of about 0.5 g/cc. However, this snus is then pouched, which can have an undesirable mouth-feel, can limit the diffusion of substances from the snus into the mouth of the user and/or can be unhygienic.

The insoluble foamed material may have a density that is similar to and/or lower than the density of conventional snus. Thus, the smokeless oral tobacco product comprising the insoluble foamed material may have a desirable density with the advantage of not requiring a pouch.

Alternatively or in addition, the density of the insoluble foamed material may be sufficiently low to allow a desirable rate of diffusion of saliva into the smokeless oral tobacco product and/or of substances from the smokeless oral tobacco product into the mouth of the user. Such diffusion rates may not be achieved without the low density insoluble foamed material of the present invention.

The insoluble foamed material may have a density of between about 0.1 g/cc and about 1.5 g/cc. The insoluble foamed material may have a density of up to 0.1 g/cc, up to 0.2 g/cc, up to 0.3 g/cc, up to 0.4 g/cc, up to 0.5 g/cc, up to 0.6 g/cc, up to 0.7 g/cc, up to 0.8 g/cc, up to 0.9 g/cc, up to 1.0 g/cc, up to 1.1 g/cc, up to 1.2 g/cc, up to 1.3 g/cc, up to 1.4 g/cc, or up to 1.5 g/cc. In some embodiments, the density of the insoluble foamed material is between about 0.3 g/cc and about 0.7 g/cc.

The insoluble foamed material may have a stabilised foamed structure. In other words, the insoluble foamed material may be resistant to collapsing, for example, during drying insoluble foamed material to the desired moisture content and/or when placed in the mouth of the user.

The insoluble foamed material and/or smokeless oral tobacco product may further comprise other components. These components may, for example, be included in order to alter the organoleptic properties of the formulation, contributing to the sensory perception by the consumer. The particular components and the amounts in which they are included in the insoluble foamed material and/or smokeless oral tobacco product of the present invention will vary depending upon the desired flavour, texture, and other characteristics.

For example, flavouring agents, preservatives, humectants and/or colorants may be included in the insoluble foamed material and/or smokeless oral tobacco product.

As used herein, the terms "flavour" and "flavourant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

The insoluble foamed material and/or smokeless oral tobacco product may comprise sensates in addition to or in place of flavourants, and these may include cooling agents and heating agents.

Alternatively or in addition, the insoluble foamed material and/or smokeless oral tobacco product may comprise at least one preservative, such as potassium sorbate.

In embodiments in which the insoluble foamed material and/or smokeless oral tobacco product further comprises one or more other component(s), these other component(s) may be added at any point during the production process. In some embodiments, the other component(s) may be added towards or at the end of the production of the insoluble foamed material.

In some embodiments, coating(s) may be added to the surface of the insoluble foamed material. These coating(s) may enhance the texture and/or flavour of the smokeless oral tobacco product. Suitable coatings may comprise flavour dust coating and/or humectant.

The tobacco content of the smokeless oral tobacco product comprising the insoluble foamed material may vary. In some embodiments, the tobacco content of the smokeless oral tobacco product may be from at least 15% to at least 50%, on a dry weight basis. The amount of tobacco within the smokeless oral tobacco product may be at least 15%, at least 20%, at least 25%, at least 30%, at least 35%, at least 40%, at least 45%, or at least 50%, on a dry weight basis. In some embodiments, the amount of tobacco within the smokeless oral tobacco product is between about 25% and about 40%, on a dry weight basis. In some embodiments, the amount of tobacco within the smokeless oral tobacco product is less than 85%.

Figure 6:
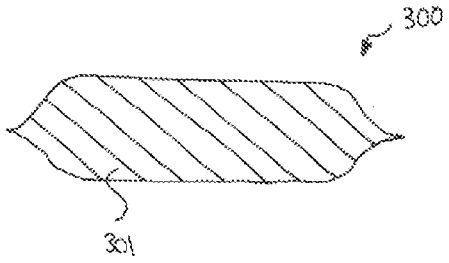
FIG. 6 is a cross-section of a smokeless oral tobacco product in accordance with an embodiment of the present invention.

FIG. 6 is a diagrammatic representation of a smokeless oral tobacco product in accordance with an embodiment of the present invention. The smokeless oral tobacco product 300 comprises an insoluble foamed material 301 produced in accordance with an embodiment of the present invention. The smokeless oral tobacco product 300 is portioned.

The smokeless oral tobacco product may be any suitable size. In some embodiments, the smokeless oral tobacco product has the following approximate dimensions: 19 mm×10 mm×5 mm.

Figure 7:
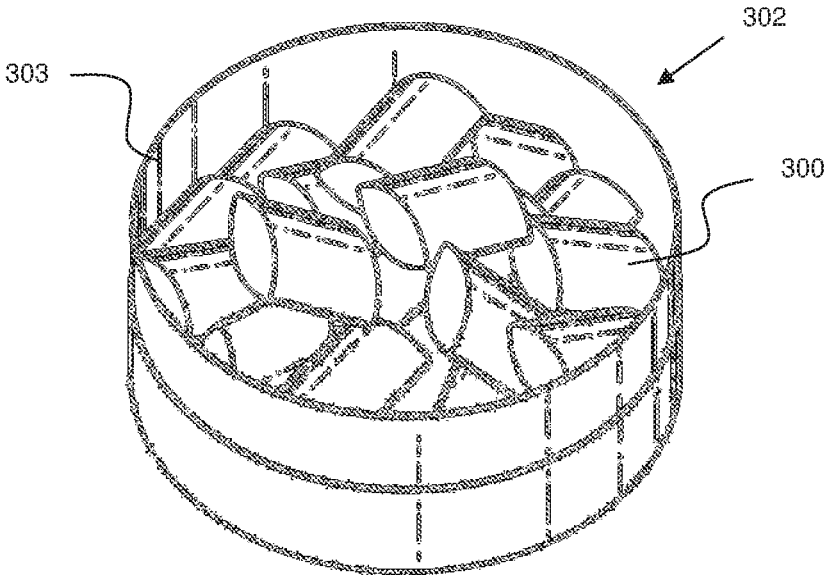
FIG. 7 is a consumer package comprising smokeless oral tobacco products in accordance with an embodiment of the present invention.

FIG. 7 shows an example of a possible consumer package 302 comprising a container 303, such as a tin in the illustrated embodiment, holding smokeless oral tobacco products 300 in accordance with an embodiment of the invention.

The smokeless oral tobacco product comprising the insoluble foamed material may comprise a pouch or fleece. In some embodiments, such as the embodiment illustrated in FIG. 6, the smokeless oral tobacco product 300 is pouchless or fleeceless. In some embodiments, the smokeless oral tobacco product is in the form of a plug.

Pouchless smokeless oral tobacco products may offer a more intimate contact between the lining of the mouth and the tobacco than pouched smokeless oral tobacco products. Pouchless smokeless oral tobacco products may therefore offer the advantage over pouched smokeless oral tobacco products that the diffusion of saliva into the smokeless oral tobacco product and/or the diffusion of substances from the smokeless oral tobacco product into the mouth of the user is not inhibited by the additional barrier of the pouch. In other words, pouchless smokeless oral tobacco products may offer a faster rate of transfer of substances such as nicotine and flavours from the smokeless oral tobacco product into the mouth of the user than pouched tobacco products. Thus, substances from the pouchless smokeless oral tobacco products may diffuse more rapidly into the mouth of the user and/or be absorbed more rapidly through the user's mucous membranes.

Alternatively or in addition, pouchless smokeless oral tobacco products may be more hygienic than pouched smokeless oral tobacco products and/or may be considered by the user to have a desirable or more acceptable mouth feel than pouched smokeless oral tobacco products.

EXAMPLES

The following examples are provided to assist in the understanding of the invention and are not intended to limit the scope of the invention.

Production of Insoluble Foamed Material According to Invention

Example 1

The following formulation was used to produce an insoluble foamed material:

6% ground tobacco
2% sodium alginate (Protanal® SF200 alginate)
10% glycerol
0.3% calcium carbonate, mean particle size of about 2 μm
2.0% hydroxy propyl methyl cellulose
1.06% glucono delta lactone
78.64% deionised water Sodium alginate was hydrated in 70% of the required water, whilst mixing at a low speed using a stand mixer with balloon whisk attachment. Glycerol, calcium carbonate and hydroxy propyl methyl cellulose were then added to the hydrated alginate, whilst mixing at a low speed. The mixing speed was increased to a high speed to entrain air into the mixture for 2-3 minutes. The glucono delta lactone was then dissolved in the remaining water and immediately added to the foamed mixture. The tobacco was added at the same time as the glucono delta lactone. The mixing speed was reduced, immediately following the addition of the glucono delta lactone, to a low speed to ensure the dispersion of the glucono delta lactone solution. The foamed mixture was then cast into appropriate moulds and left to form a fully gelled structure.

Onset of gelation commenced after about 10 seconds following the addition of the glucono delta lactone. On a dry weight basis, the insoluble foamed material contained 25% tobacco, and had a dry foam density of 0.5-0.7 g/cc.

Example 2

The following formulation was used to produce an insoluble foamed material, using the method of Example 1:

6% ground tobacco
2% sodium alginate (Protanal® SF200 alginate)
10% glycerol
0.3% calcium carbonate, mean particle size of about 75 μm
2.0% hydroxy propyl methyl cellulose
1.06% glucono delta lactone
78.64% deionised water Onset of gelation commenced after about 1 minute following the addition of the glucono delta lactone. On a dry weight basis, the resulting insoluble foamed material contained 25% tobacco and had a dry foam density of 0.5-0.7 g/cc.

Example 3

The following formulation was used to produce an insoluble foamed material, using the method of Example 1:

9.1% ground tobacco
1.8% sodium alginate (Protanal® SF200 alginate)
9.1% glycerol
0.3% calcium carbonate, mean particle size of about 75 μm
1.8% hydroxy propyl methyl cellulose
1.0% glucono delta lactone
76.9% deionised water Onset of gelation commenced after about 30 seconds following the addition of the glucono delta lactone. On a dry weight basis, the resulting insoluble foamed material contained 40% tobacco and had a dry foam density of 0.6-0.8 g/cc.

Example 4

The following formulation was used to produce an insoluble foamed material, using the method of Example 1:
9.1% ground tobacco
1.8% sodium alginate (Protanal® SF200 alginate)
9.1% glycerol
0.07% calcium carbonate
1.8% hydroxy propyl methyl cellulose
1.0% glucono delta lactone
78.03% deionised water Onset of gelation commenced after about 1 minute following the addition of the glucono delta lactone, and gelation progressed slower than the formulations of Examples 1 to 3, enabling casting of the insoluble foamed material. The insoluble foamed material was substantially gelled after about 10 minutes, and retained its cast volume during drying. On a dry weight basis, the resulting insoluble foamed material contained 40% tobacco and had a dry foam density of 0.3-0.4 g/cc.

The density of pouched snus is 0.5 g/cc and the density of loose snus is 1.56 g/cc. It is therefore clear that the insoluble foamed material produced according to the present invention has density that is lower than the density of a pouchless smokeless oral tobacco product.

Example 5

The following formulation was used to produce an insoluble foamed material, using the method of Example 1:
40 g ground tobacco
8 g sodium alginate
40 g glycerol
0.5 g calcium carbonate
8 g hydroxy propyl methyl cellulose
4.24 g glucono delta lactone
340 g deionised water.

In order to address various issues and advance the art, the entirety of this disclosure shows by way of illustration various embodiments in which the claimed invention(s) may be practiced and provide for superior smokeless oral tobacco products. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An oral tobacco product, comprising:
tobacco; and an insoluble foamed material, the insoluble foamed material being a combination of a foaming agent, a chemically cross-linkable agent capable of forming chemical cross-linkages, and a cross-linking agent,
wherein the insoluble foamed material is insoluble in the mouth of a user,
wherein the insoluble foamed material has a density of 0.3 g/cc to 0.7 g/cc such that saliva diffuses into the oral tobacco product and that substances diffuse from the oral tobacco product into the mouth of the user;
wherein the insoluble foamed material has a moisture content of at least 35%, and
wherein the oral tobacco product is smokeless, and wherein the oral tobacco product is configured to be placed in the oral cavity of a user providing contact between the user's saliva and the oral tobacco product;
wherein the oral tobacco product comprises a pouch surrounding the insoluble foamed material.

2. The oral tobacco product according to claim 1, wherein the chemically cross-linkable agent capable of forming chemical cross-linkages comprises at least one of an alginate and/or a pectin.

3. The oral tobacco product according to claim 1, wherein the cross-linking agent is a source of polyvalent cations.

4. The oral tobacco product according to claim 3, wherein the cross-linking agent is tobacco and/or calcium carbonate.

5. The oral tobacco product according to claim 1, wherein the foaming agent comprises a substituted cellulose.

6. The oral tobacco product according to claim 1, wherein the tobacco comprises particulate tobacco.

7. The oral tobacco product according to claim 1, wherein the tobacco comprises moist snuff.

8. The oral tobacco product according to claim 6, wherein the particulate tobacco has a particle size of between about 0.1 mm and 1.0 mm.

9. The oral tobacco product according to claim 1, wherein the moisture content of the tobacco is less than about 55%.

10. A consumer package comprising the oral tobacco product of claim 1.

11. The oral tobacco product according to claim 2, wherein the alginate is sodium alginate.

12. The oral tobacco product according to claim 3, wherein the cross-linking agent is a $Ca^{2+}$ ion source.

13. The oral tobacco product according to claim 7, wherein the tobacco comprises Swedish-style snuff.

14. The oral tobacco product according to claim 1, wherein the oral tobacco product is in the form of a sphere, tablet, or disk.

15. The oral tobacco product according to claim 1, wherein the cross-linking agent is in the form of particles having a particle diameter of from 1 μm to 250 μm.

* * * * *